US006743478B1

(12) United States Patent
Kiiha et al.

(10) Patent No.: US 6,743,478 B1
(45) Date of Patent: Jun. 1, 2004

(54) CURTAIN COATER AND METHOD FOR CURTAIN COATING

(75) Inventors: Timo Kiiha, Menasha, WI (US); Jukka Koskinen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/069,662

(22) PCT Filed: Sep. 1, 2000

(86) PCT No.: PCT/FI00/00746

§ 371 (c)(1),
(2), (4) Date: Feb. 27, 2002

(87) PCT Pub. No.: WO01/16427

PCT Pub. Date: Mar. 8, 2001

(30) Foreign Application Priority Data

Sep. 1, 1999 (FI) ..... 19991863

(51) Int. Cl.[7] ..... B05D 1/30; B05C 5/00

(52) U.S. Cl. ..... 427/294; 427/296; 427/348; 427/420; 118/50; 118/63; 118/68; 118/324; 118/DIG. 4

(58) Field of Search ..... 427/420, 294, 427/296, 348; 118/DIG. 4, 50, 68, 63, 324

(56) References Cited

U.S. PATENT DOCUMENTS

| | | | | | |
|---|---|---|---|---|---|
| 4,128,667 | A | * | 12/1978 | Timson | 427/348 |
| 5,044,305 | A | * | 9/1991 | Shibata et al. | 118/73 |
| 5,340,402 | A | | 8/1994 | Beisswanger | 118/410 |
| 5,624,715 | A | | 4/1997 | Gueggi et al. | 427/420 |
| 5,688,325 | A | | 11/1997 | Aidun | 118/410 |
| 5,733,608 | A | * | 3/1998 | Kessel et al. | 427/547 |
| 5,773,093 | A | | 6/1998 | Mitani et al. | 427/420 |
| 5,820,674 | A | | 10/1998 | Aidun | 118/410 |
| 5,885,659 | A | | 3/1999 | Takahashi et al. | 427/420 |
| 6,146,690 | A | * | 11/2000 | Kustermann | 427/8 |

FOREIGN PATENT DOCUMENTS

| | | | |
|---|---|---|---|
| GB | 1080523 | * | 8/1967 |
| JP | 08-001061 | * | 1/1996 |
| JP | 10-165868 | * | 6/1998 |

* cited by examiner

*Primary Examiner*—Katherine A. Bareford
(74) *Attorney, Agent, or Firm*—Cohen, Pontani, Liberman & Pavane

(57) ABSTRACT

A curtain coater and a curtain-coating method for coating a moving web of paper or board are described. The curtain coater has an applicator nozzle for applying a coating mix to the surface of the web in the form of a continuous curtain extending uniformly over the cross-machine width of the web. In one aspect, a doctoring means located upstream (in terms of the direction of travel of the web) from the applicator nozzle substantially removes the air boundary layer traveling on the surface of the web. In another aspect, the doctoring means comprises a suction nozzle for removing the air boundary layer. In yet another aspect, a gas nozzle located downstream from the applicator nozzle sprays gas on the coating curtain in order to help apply the coating mix to the surface of the web.

28 Claims, 2 Drawing Sheets

CURTAIN COATER AND METHOD FOR CURTAIN COATING

PRIORITY CLAIM

This is a national stage of PCT Application No. PCT/FI00/00746, filed on Sep. 1, 2000. Priority is claimed on that application and on application No. 991863, filed in Finland on Sep. 1, 1999.

FIELD OF THE INVENTION

The present invention relates to a curtain coater and to a curtain-coating method.

BACKGROUND OF THE INVENTION

In a curtain coater, the coating mix is applied to the surface of a moving web of paper or board, generally from a nozzle extending over the full cross-machine width of the web and located above the web being coated, whereby the coating mix can fall onto the web surface as curtain-like shower. Curtain coating is categorized as a noncontacting coating method, wherein the applicator itself makes no contact with the web being coated, but instead, the coating mix is applied to the web surface in the form of a free-falling curtain of coating mix. The technique of curtain coating is described, e.g., in publication DE 196 22 080.

During its travel, a moving web gathers a thin boundary layer of air that moves along with the web. In curtain coaters, the momentum of the coating mix applied to the web surface is small as compared to the momentum of the coating mix amount directed from a jet applicator, for instance, which means that the boundary air layer traveling on the web surface can easily scatter the curtain of coating mix flowing from the nozzle of a curtain coater thus making the applied coating layer uneven. With higher web speeds in the coater station, the problem is accentuated due to the faster speed of the boundary air layer and its higher momentum. Hence, the control of the boundary air layer behavior at higher web speeds becomes one of the most significant factors affecting the runnability of a curtain coater.

The problem associated with the boundary air layer can be diminished by way of, e.g., making the height of the falling curtain of coating mix larger thereby increasing its falling velocity or by increasing the amount of coating being applied, whereby the momentum of the coating mix curtain is increased and the falling curtain can more readily penetrate through the boundary air layer traveling on the web surface. However, it is generally not possible to make the falling height of the coating mix curtain sufficiently large because the coating mix curtain begins to converge and separate into streamlets with a larger falling height. Moreover, the increase of the amount of the applied coating mix necessitates doctoring away the excess coating from the web surface.

SUMMARY OF THE INVENTION

It is an object of the present invention to provide an entirely novel type of curtain coater and curtain-coating method offering an essential improvement in the reduction of the amount of boundary air penetration to the application zone of a curtain coater.

The goal of the invention is attained by way of placing a doctoring means upstream in front of the application point in the travel direction of the web being coated, the device serving to remove the boundary air layer from the surface of the traveling web. The purpose of the doctoring means is to bring about a significant reduction in the amount of the entrained air traveling along with the web to the application zone. In one embodiment of the invention, the amount of the boundary air coming to the application zone is reduced by means of a suction nozzle cooperating with the air-doctoring element, whereby the boundary air layer is removed via the suction nozzle by a vacuum. Additionally, the adherence of the coating mix curtain to the web surface can be augmented by means of a gas-injection nozzle mounted downstream after the applicator nozzle in the travel direction of the web, whereby a gas jet can be directed from the gas-injection nozzle toward the coating mix curtain. Hereby, the combined momentum of the coating mix curtain and the gas jet becomes sufficiently energetic to force the coating mix to penetrate through the boundary air layer traveling on the web surface.

The invention offers significant benefits.

In a curtain coater according to the invention, the amount of boundary air traveling on the web being coated to the application zone can be reduced significantly as compared with conventional curtain coaters, whereby the coat quality and web runnability in the coater are improved. The web speed in a curtain coater according to the invention can be readily increased because the boundary air layer can be removed effectively from the surface of the running web prior to application.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be examined in greater detail by making reference to the appended drawings in which.

DETAILED DESCRIPTION OF THE PRESENTLY PREFERRED EMBODIMENTS

Figure 1:
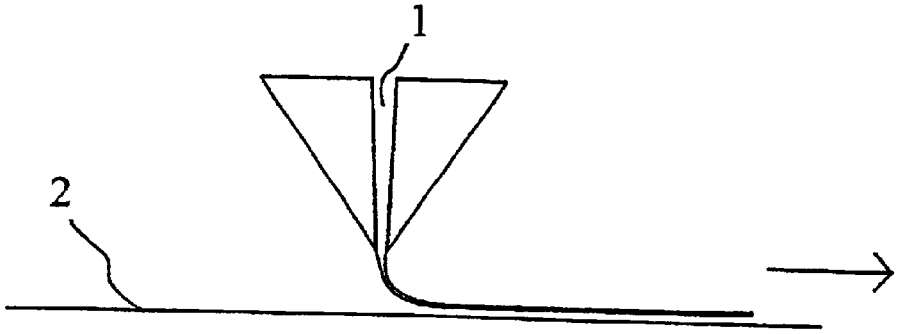
FIG. 1 shows schematically a cross-sectional side view of a conventional curtain coater.

Referring to FIG. 1, the conventional curtain coater shown therein comprises an applicator nozzle 1 placed above a web 2 and extending in the cross-machine direction above the web 2 so as to permit application of the coating mix therefrom to the surface of the moving web 2. The travel direction of the web 2 is designated by an arrow. The boundary air layer traveling on the surface of the moving web 2 tends to deflect the curtain of coating mix being applied from the nozzle 1 in the travel direction of the moving web 2. At a sufficiently high travel speed of the web, the steady flow of the coating mix curtain is disturbed and a portion of the applied coating mix is blown along with the boundary air in the travel direction of the web 1, whereby certain areas on the surface of the web 2 may remain entirely uncoated.

Figure 2:
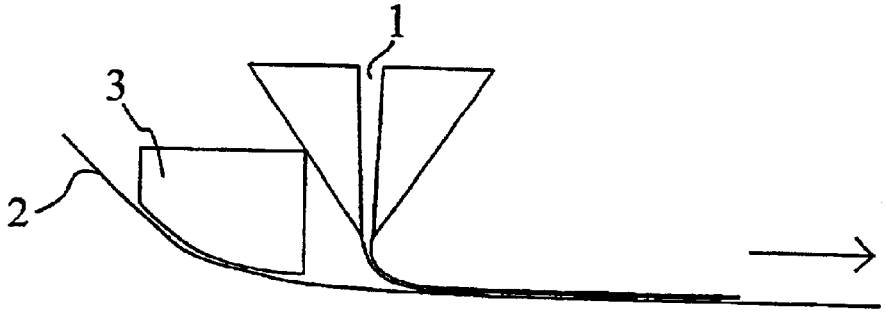
FIGS. 2, 3, 4, 5, 6, and 7 shows schematically cross-sectional side views of different embodiments of curtain coaters according to the invention.

In FIG. 2 is shown an embodiment of a curtain coater, wherein there is located upstream in front of the application zoned formed its applicator nozzle 1, upstream in the travel direction of the web 2, a doctoring means 3 having a curved contour and extending over the cross-machine width of the web 2 so as to scatter the boundary air layer traveling on the surface of moving web 2 before the air layer can reach the application zone and cause there problems in the coat quality. The doctoring means 3 is disposed so that its curved contour is above the surface of the web 2. Generally, between the moving web 2 and the doctoring means 3 is formed a boundary air layer, the thickness of which is determined, among other factors, by the speed of the web 2 and the radius of curvature on the curved contour of the doctoring means. Typically, the thickness of the air layer remaining between the web 2 and the curved contour of the doctoring means 3 is in the range of 0–500 $\mu$m. The end point of the curved contour of the doctoring means 3 facing the web 2 is advantageously placed as close as possible to the starting point of the application zone under the nozzle 1, since a new layer of boundary air will be rapidly regenerated over a free length of the web downstream from the doctoring means 3. In practice, the boundary air layer can reach its original thickness within 50 mm of web travel.

Figure 3:
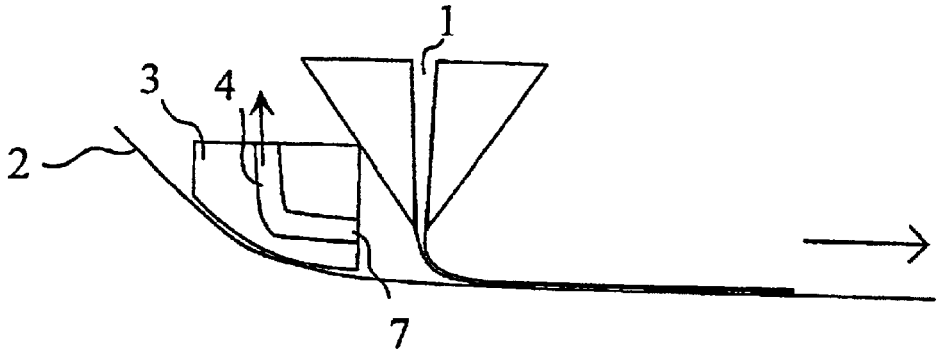

In contrast to the arrangement of FIG. 2, the embodiment shown in FIG. 3 has the doctoring means 3 complemented with a suction channel 4 extending over the cross-machine width of the web 2 and having its inlet opening 7 located at the rear part of the doctoring means 3. In this fashion, the boundary air layer traveling on the surface of the moving web 2 can be sucked into the suction channel 4.

Figure 4:
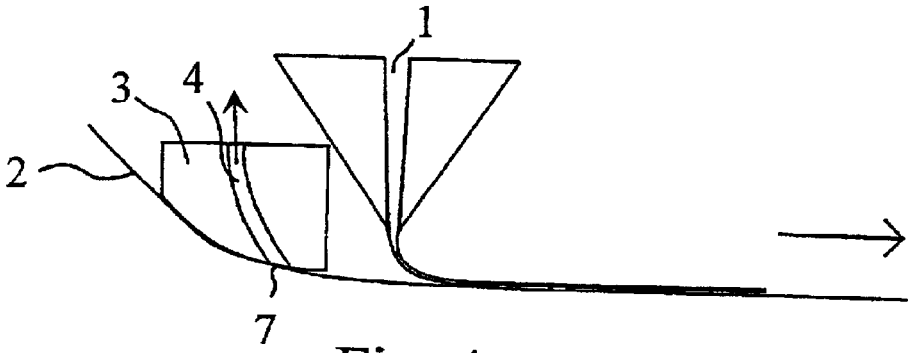

In FIG. 4 is shown an arrangement wherein the inlet opening 7 of the suction channel 4 is adapted on the curved surface of the doctoring means 3 facing the web 2.

Figure 5:
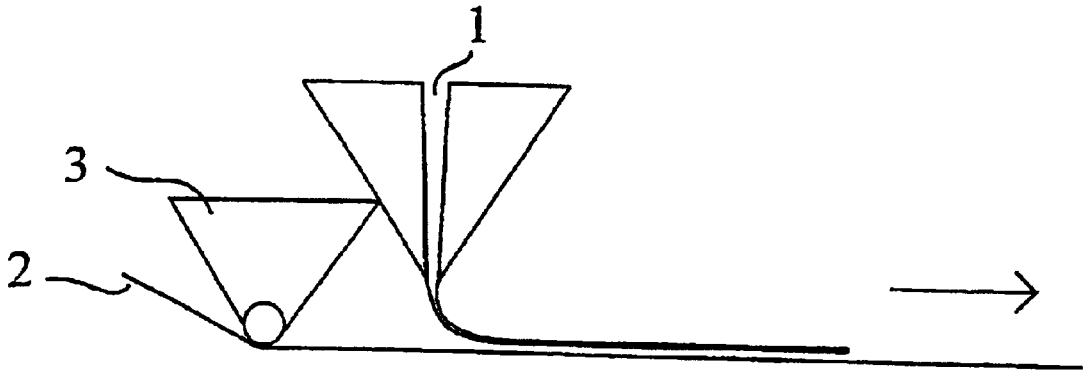

In FIG. 5 is shown an arrangement wherein there is placed upstream in front of the application zone of the applicator nozzle 1 a doctor bar 3 so that the bar makes a contact with the moving web 2 thus preventing the boundary air layer traveling on the moving web from reaching the application zone.

Figure 6:
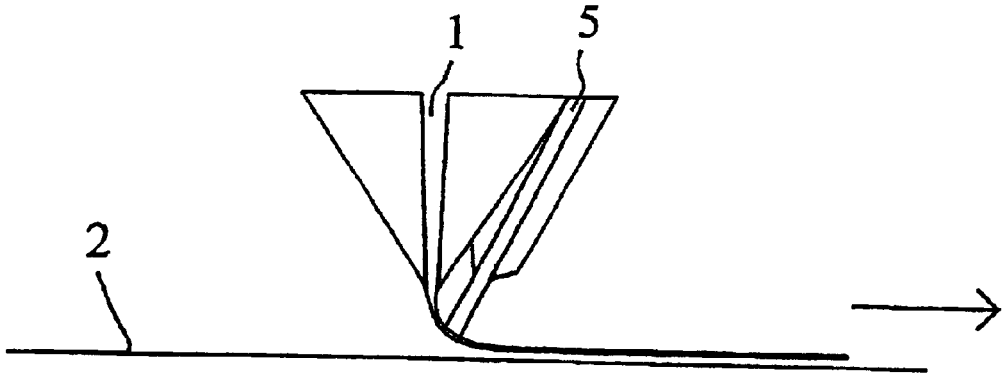

In FIG. 6 is shown an embodiment wherein there is placed downstream after the applicator nozzle 1 in the travel direction of the moving web 2 a gas-injection nozzle 5 extending over the cross-machine width of the web and adapted to direct a gas jet toward the coating mix curtain falling from the applicator nozzle. In the context of the present invention, the term gas is used when reference is made to any substance occurring in a gas phase including air, other gases and steam. When the combined momentum of the gas jet directed from the gas-injection nozzle 5 and the falling curtain of coating mix is sufficiently large as compared with the momentum of the boundary air layer traveling on the surface of the moving web 2, the coating mix curtain can unobstructedly adhere to the surface of the web 2. The streams flowing out from the applicator nozzle 1 and the gas-injection nozzle 5 are aligned to meet with each other before the coating mix curtain impinges on the web 2. By altering the operating pressure of the gas-injection nozzle 5, the adherence of the coating mix layer to the surface of the web 2 can be controlled.

Figure 7:
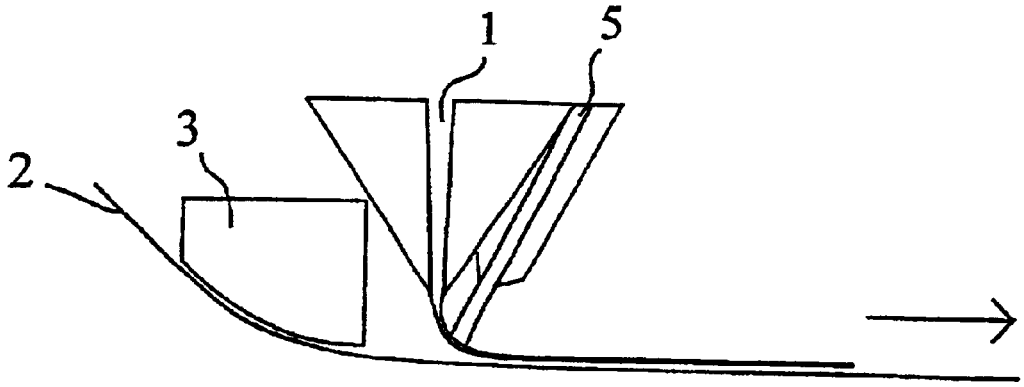

In FIG. 7 is shown an embodiment different from that of FIG. 6 by having a doctoring means 3 added upstream in front of the applicator nozzle 1 in the travel direction of the web 2 so as to remove the boundary air layer from the surface of the moving web 2. Herein, the doctoring means 3 serves to remove a portion of the boundary air layer, while the gas-injection nozzle 5 assures unobstructed adherence of the coating mix curtain to the surface of the web 2.

In addition to those described above, the invention may have alternative embodiments.

A rotary or stationary small roll can be used as the doctoring means 3. Also different modifications of the above-described exemplifying embodiments may be contemplated. For instance, the doctoring means 3 used in the embodiment of FIG. 7 can be complemented when necessary with the suction nozzles 4 used in the embodiments of FIGS. 3 and 4 thus improving the efficiency of boundary air removal from the surface of the web 2.

Thus, while there have been shown and described and pointed out fundamental novel features of the present invention as applied to a preferred embodiment thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A curtain-coating method for coating a moving web of paper or board, comprising:

passing the web to be coated to a coater station;

using an applicator nozzle positioned above the web to apply coating mix ejected therefrom to a surface of the web as a continuous curtain extending uniformly over a cross-machine width of the web;

removing a boundary air layer traveling along with the web from the surface of the web facing the applicator nozzle by suction from a suction nozzle in a doctoring means located upstream in the travel direction of the web of the applicator nozzle; and supporting the web with a curved surface of the doctoring means.

2. The curtain-coating method of claim 1, further comprising blowing gas toward the coating mix curtain being applied from the applicator nozzle from a gas-injection nozzle located downstream of the applicator nozzle in the travel direction of the web, the gas-injection nozzle extending over the cross-machine width of the web.

3. A curtain coater for coating a moving web of paper or board, the curtain coater comprising:

an applicator nozzle positioned above the web to be coated and configured so as to apply coating mix ejected therefrom to a surface of the web in a continuous curtain extending uniformly over a cross-machine width of the web; and a doctoring means configured to remove a boundary air layer traveling on the surface of the web to be coated and being located upstream in the travel direction of the web of an impingement point of the coating mix curtain on the surface of the web and being located on the same side of the web as the applicator nozzle, the surface of the doctoring means facing the web being curved to support the web, wherein said doctoring means comprises a suction nozzle extending over the cross-machine width of the web and set in the doctoring means so as to remove by suction the boundary air layer traveling on the surface of the web.

4. The curtain coater of claim 3, further comprising a gas-injection nozzle located downstream in the travel direction of the web of the applicator nozzle, configured so as to extend over the cross-machine width of the web, and adapted to blow gas toward the coating mix curtain applied to the web from the applicator nozzle.

5. The curtain coater of claim 4, wherein an inlet opening of the suction nozzle is on a downstream-directed wall of the doctoring means.

6. The curtain coater of claim 5, wherein a distance between the web and the curved surface of the doctoring means is up to 500 μm.

7. The curtain coater of claim 5, wherein a distance along the surface of the web from a downstream end of said doctoring means to the impingement point under said applicator nozzle is less than 50 mm.

8. The curtain coater of claim 4, wherein an inlet opening of the suction nozzle is on a surface of the doctoring means facing the web.

9. The curtain coater of claim 8, wherein a distance between the web and the curved surface of the doctoring means is up to 500 μm.

10. The curtain coater of claim 8, wherein a distance along the surface of the web from a downstream end of said doctoring means to the impingement point under said applicator nozzle is less than 50 mm.

11. The curtain coater of claim 4, wherein a distance between the web and the curved surface of the doctoring means is up to 500 μm.

12. The curtain coater of claim 4, wherein a distance along the surface of the web from a downstream end of said doctoring means to the impingement point under said applicator nozzle is less than 50 mm.

13. The curtain coater of claim 3, wherein an inlet opening of the suction nozzle is on a downstream-directed wall of the doctoring means.

14. The curtain coater of claim 13, wherein a distance between the web and the curved surface of the doctoring means is up to 500 μm.

15. The curtain coater of claim 13, wherein a distance along the surface of the web from a downstream end of said doctoring means to the impingement point under said applicator nozzle is less than 50 mm.

16. The curtain coater of claim 3, wherein an inlet opening of the suction nozzle is on a surface of the doctoring means facing the web.

17. The curtain coater of claim 16, wherein a distance between the web and the curved surface of the doctoring means is up to 500 μm.

18. The curtain coater of claim 16, wherein a distance along the surface of the web from a downstream end of said doctoring means to the impingement point under said applicator nozzle is less than 50 mm.

19. The curtain coater of claim 3, wherein a distance between the web and the curved surface of the doctoring means is up to 500 μm.

20. The curtain coater of claim 19, wherein a distance along the surface of the web from a downstream end of said doctoring means to the impingement point under said applicator nozzle is less than 50 mm.

21. The curtain coater of claim 3, wherein a distance along the surface of the web from a downstream end of said doctoring means to the impingement point under said applicator nozzle is less than 50 mm.

22. A curtain coater for coating a moving web of paper or board, the curtain coater comprising:

an applicator nozzle for applying a coating mix to a surface of the web in a continuous curtain extending uniformly over a cross-machine width of the web; and a doctoring means located upstream relative to a travel direction of the web from an application zone where the coating curtain impinges the web surface, wherein said doctoring means comprises:

a curved surface for receiving the web and substantially removing a boundary air layer above the web surface before the coating curtain impinges the web surface, wherein the web follows a curvature of said curved surface and the web surface faces said curved surface; and a suction nozzle for substantially removing the boundary air layer, wherein said suction means extends over the cross-machine width of the web.

23. The curtain coater of claim 22, further comprising a gas-injection nozzle for augmenting an adherence of the coating curtain to the web surface by blowing gas toward the coating curtain, said gas nozzle being positioned downstream relative to the travel direction of the web from the applicator nozzle such that a momentum of the blown gas and a momentum of the coating curtain may combine to force the coating mix to penetrate the boundary air layer.

24. The curtain coater of claim 22, wherein an inlet opening of the suction nozzle in the doctoring means faces the coating curtain.

25. The curtain coater of claim 22, wherein an inlet opening of the suction nozzle in the doctoring means is on the curved surface of the doctoring means.

26. The curtain coater of claim 22, wherein a distance between the web surface and the curved surface of the doctoring means is up to 500 μm.

27. The curtain coater of claim 22, wherein the curved surface of the doctoring means comprises an end surface comprises the portion of the curved surface nearest the application zone, wherein said end surface is positioned as close as possible to the application zone.

28. The curtain coater of claim 27, wherein the doctoring means is positioned such that the end surface is within about 50 mm of the application zone.

* * * * *